US010914062B2

(12) United States Patent
Dimitrov

(10) Patent No.: US 10,914,062 B2
(45) Date of Patent: Feb. 9, 2021

(54) SELF-SUPPORTING THREE-DIMENSION PRESTRESSED STRUCTURE, METHOD AND DEVICE FOR ITS CONSTRUCTION

(71) Applicant: ICDSOFT Ltd, Sofia (BG)

(72) Inventor: Dimitar Stoev Dimitrov, Sofia (BG)

(73) Assignee: ICDSOFT Ltd, Sofia (BG)

( * ) Notice: Subject to any disclaimer, the term of this patent is extended or adjusted under 35 U.S.C. 154(b) by 0 days.

(21) Appl. No.: 16/307,642

(22) PCT Filed: Jun. 15, 2017

(86) PCT No.: PCT/BG2017/000010
§ 371 (c)(1),
(2) Date: Dec. 6, 2018

(87) PCT Pub. No.: WO2018/014094
PCT Pub. Date: Jan. 25, 2018

(65) Prior Publication Data

US 2019/0211545 A1 Jul. 11, 2019

(30) Foreign Application Priority Data

Jul. 20, 2016 (BG) ..... 112336

(51) Int. Cl.
*E04B 1/32* (2006.01)
*E04B 1/35* (2006.01)
(Continued)

(52) U.S. Cl.
CPC ..... *E04B 1/35* (2013.01); *E04B 1/165* (2013.01); *E04B 1/166* (2013.01); *E04B 1/3211* (2013.01);
(Continued)

(58) Field of Classification Search
CPC . E04B 1/35; E04B 1/165; E04B 1/166; E04B 2001/0061; E04B 2001/3583;
(Continued)

(56) References Cited

U.S. PATENT DOCUMENTS 1,338,484 A * 4/1920 Baker ..... E04H 7/26
264/32
3,292,316 A * 12/1966 Zeinetz ..... E04B 7/10
52/81.4

(Continued)

*Primary Examiner* — Brian E Glessner
*Assistant Examiner* — James J Buckle, Jr.
(74) *Attorney, Agent, or Firm* — Luoh J. Wu; Continent Patent Office LLP

(57) ABSTRACT

This invention relates to a self-supporting three-dimensional prestressed structure, as well as a method and a device for erecting same, to be employed in the construction of residential and nonresidential buildings.

The structure is constructed of vertical form-defining flexible rodlike members (1) stressed during the construction of the structure, as well as horizontal flexible rodlike members (2) each forming a closed curve. The horizontal members (2) are also stressed during construction and welded or rigidly affixed by other means to the vertical form-defining members (1).

Instead of horizontal circular members (2) the structure can be constructed completely or to some extent using a spiral member, also stressed during the construction of the structure that is rigidly affixed to the vertical form-defining flexible members (1).

2 Claims, 9 Drawing Sheets

(51) Int. Cl.
*E04B 1/16* (2006.01)
*E04B 1/00* (2006.01)

(52) U.S. Cl.
CPC ..... *E04B 2001/0061* (2013.01); *E04B 2001/3217* (2013.01); *E04B 2001/3583* (2013.01)

(58) Field of Classification Search
CPC ..... E04B 1/168; E04B 1/3211; E04B 2001/3235; E04B 2001/3241; E04B 2001/3247; E04B 2001/3252; E04B 1/19; E04B 1/32; E04B 1/3205; E04B 7/08; E04B 7/10; E04B 7/20; E04B 7/26; E04B 7/102; E04H 15/34; E04H 15/36; E04H 15/38; E04H 15/40; E04H 15/44; E04H 15/46; E04H 15/48; E04H 15/42; Y10S 52/10
USPC ..... 52/80.1; 135/124, 125, 126, 127; 47/17
See application file for complete search history.

(56) References Cited

U.S. PATENT DOCUMENTS 4,144,680 A * 3/1979 Kelly ..... E04B 1/3211 126/628
5,067,505 A * 11/1991 Cantwell ..... E04H 15/40 135/115
5,094,044 A * 3/1992 Dykmans ..... B65D 88/34 156/143
5,097,640 A * 3/1992 Skolnick ..... E04B 1/3211 434/286
5,146,719 A * 9/1992 Saito ..... E04B 1/3211 52/80.1
5,408,793 A * 4/1995 Dykmans ..... B65D 88/34 52/81.6
5,555,681 A * 9/1996 Cawthon ..... A01G 9/16 52/63
5,595,203 A * 1/1997 Espinosa ..... E04H 15/36 135/123
5,724,775 A * 3/1998 Zobel, Jr. ..... E04B 1/3211 359/443
6,324,792 B1 * 12/2001 DeGarie ..... E04B 7/10 403/217
6,354,315 B1 * 3/2002 Liu ..... A45B 19/12 135/28
6,381,767 B1 * 5/2002 Brashears ..... E04H 4/108 135/124
6,401,404 B1 * 6/2002 Fillipp ..... B44C 5/00 362/249.04
6,868,858 B2 * 3/2005 Suh ..... E04H 15/50 135/131
6,929,017 B2 * 8/2005 Byun ..... E04H 15/50 135/131
7,152,384 B1 * 12/2006 McCarty ..... E04B 1/3211 52/639
7,765,746 B2 * 8/2010 Reed ..... E04H 9/14 52/80.1
7,849,639 B2 * 12/2010 Sprung ..... E04H 15/18 52/82
8,054,547 B2 * 11/2011 Anderson ..... G03B 21/58 359/460
8,297,282 B2 * 10/2012 Holley ..... A61G 10/026 128/205.26
8,307,605 B2 * 11/2012 McCarty ..... E04B 7/08 52/745.07
8,511,327 B2 * 8/2013 Sun ..... A45B 11/00 135/20.1
8,621,790 B2 * 1/2014 Lekhtman ..... E04D 13/0481 52/167.1
9,303,427 B1 * 4/2016 Arndt ..... E04H 15/48
9,783,983 B1 * 10/2017 Fairbanks ..... E04H 1/12
9,901,149 B2 * 2/2018 Arndt ..... E04H 15/28
10,041,271 B2 * 8/2018 Jin ..... E04H 15/64
2002/0153033 A1 * 10/2002 Miller ..... E04B 1/3211 135/121
2002/0179133 A1 * 12/2002 Abbinante ..... E04H 15/40 135/124
2003/0101663 A1 * 6/2003 Boots ..... E04B 1/3211 52/81.3
2004/0045227 A1 * 3/2004 South ..... E04B 1/169 52/80.1
2005/0210767 A1 * 9/2005 DeFever ..... E04B 1/169 52/80.1
2007/0251161 A1 * 11/2007 Tuczek ..... E04B 7/102 52/80.1
2008/0022607 A1 * 1/2008 Eldeib ..... B23K 37/0443 52/80.1
2008/0236057 A1 * 10/2008 McCarty ..... E04B 7/08 52/80.1
2008/0271387 A1 * 11/2008 Fritzel ..... G01R 29/0821 52/80.1
2009/0013615 A1 * 1/2009 Kitagawa ..... E04B 1/34315 52/79.12
2009/0049763 A1 * 2/2009 Blundell ..... E04B 1/3211 52/81.1
2010/0037930 A1 * 2/2010 Miller ..... E04H 15/44 135/143
2011/0192437 A1 * 8/2011 Adams ..... E04H 15/38 135/124
2012/0055525 A1 * 3/2012 Choi ..... E04H 15/40 135/147
2013/0014791 A1 * 1/2013 Hill ..... E04H 9/145 135/93
2013/0340800 A1 * 12/2013 Liu ..... A45B 11/00 135/20.1
2015/0167343 A1 * 6/2015 Fang ..... E04H 15/32 135/120.3
2015/0275541 A1 * 10/2015 Lamke ..... E04H 15/48 135/139
2015/0284973 A1 * 10/2015 Arndt ..... E04H 15/28 135/98
2015/0284974 A1 * 10/2015 Choi ..... E04H 15/32 135/120.3

* cited by examiner

SELF-SUPPORTING THREE-DIMENSION PRESTRESSED STRUCTURE, METHOD AND DEVICE FOR ITS CONSTRUCTION

APPLICATION OF THE INVENTION

This invention relates to a self-supporting three-dimensional prestressed structure, as well as a method and a device for erecting same, to be employed in the construction of residential and nonresidential buildings and specifically civic and production halls, greenhouses, temples, swimming pools and other similar three-dimensional premises.

BACKGROUND AND EXISTING TECHNOLOGIES

A well-known and widely-used method for the construction of three-dimensional structures comprises the assembly of preformed elements to form the intended three-dimensional structure with the required shape. The most common materials for building a structure of this type and by this method are preformed metal profiles.

The structure erected by this method is not prestressed, and requires considerable expenditure of materials.

Another method used in practice for erecting self-supporting structures comprises the preselection of a site where to construct the intended structure, followed by leveling and laying a foundation. Part of an inflatable membrane with the required shape and size is then placed symmetrically in relation to a predetermined geometric center and secured airtightly to the foundation. The membrane is inflated to the required shape by injecting compressed air between its lower edge and the foundation. Polyurethane foam material is then sprayed against the under surface of the inflated form. After the foam becomes rid it is strengthened by the attachment of reinforcing rods. The structure can then be pressure sprayed with concrete (shotcrete)m, if necessary.

The self-supporting three-dimensional structure is thus constructed of an inflated membrane sprayed against the under surface with polyurethane foam and reinforced by regularly spaced members attached to one another in sequence.

This method relies on the use of an inflatable membrane or part thereof, which is costly and in most cases not reusable. The method is also restricted to the construction of concrete structures.

DESCRIPTION OF THE INVENTION

It is an object of this invention to create a self-supporting three-dimensional prestressed structure with improved tensile strength and stability, and with low expenditure of materials.

Another object of this invention is to provide a method based on improved technology for construction of self-supporting three-dimensional prestressed structures.

A further object of this invention is to create a device for implementing the method for construction of self-supporting three-dimensional prestressed structures.

These objects are achieved by means of a self-supporting three-dimensional prestressed structure comprising regularly spaced members attached to one another in sequence to form a three-dimensional building or part thereof.

According to this invention the self-supporting three-dimensional prestressed structure comprises vertical form-defining flexible rodlike members stressed during the construction of the structure, as well as horizontally and/or spirally positioned flexible rodlike members also stressed during construction, each forming a closed curve. The horizontal closed-curve members are rigidly joined to the vertical form-defining members.

Both the vertical and the horizontal closed-curve flexible rodlike members are made of metal.

The device for construction of self-supporting three-dimensional prestressed structures comprises a number of symmetrically and radially positioned telescopic arms each hinged to a circle positioned at the center of the device. At the tip of each telescopic arm there is a guide block holding a corresponding vertical rodlike member.

According to one possible embodiment, the guide block comprises two parallel plates (cheeks) fixed to the telescopic arms, whereas between said cheeks are installed in sequence grooved rollers. The opening between the rollers is at least equal to the cross-sectional diameter of the vertical rodlike member to be held between them.

The method for construction of self-supporting three-dimensional prestressed structures requires the selection of a geometric center for the intended structure. According to the invention the method also comprises the following operations in the below-stated sequence:

- positioning and affixing of the central circle of the device at the geometric center of the structure;
- configuration of the telescopic arms of the device for construction of self-supporting three-dimensional prestressed structures to conform to its intended shape, and size;
- insertion of one end of each vertical rodlike member through a guiding block on the respective telescopic arm and into a prepared socket in the foundation;
- the next stage is the incremental upward movement of each telescopic arm along the respective flexible vertical rodlike member, either in sequence or simultaneously, thus stressing the flexible vertical member;
- after each incremental upward step of all telescopic arms, the achieved elevation is fixed by attachment of horizontal flexible rodlike members around the circumference of the structure to form a contour;
- the device is removed after the self-supporting three-dimensional prestressed structure has been completed.

According to the method, openings of a given shape are made in the structure by first making frames with the required dimensions and shape, and then affixing them at the required positions. The bordering sections of the structure are affixed to the frames permanently, and then the excess parts of the structure enclosed in the frames are cut away.

The self-supporting three-dimensional prestressed structure thus erected is then sheathed in reinforcing mesh, plastered over and finished in an appropriate building material, such as cement, clay, adhesive mix.

The advantages of the invention are found in the improved speed of construction of the structure, the decreased expenditure of materials and the lower cost, as well as the capability to erect structures of various shapes.

Another major advantage of the self-supporting three-dimensional prestressed structure is the improved tensile strength.

DESCRIPTION OF THE DRAWINGS

A possible embodiment of the invention is illustrated by the drawings, whereas.

AN EXAMPLE EMBODIMENT OF THE INVENTION

Figure 1:
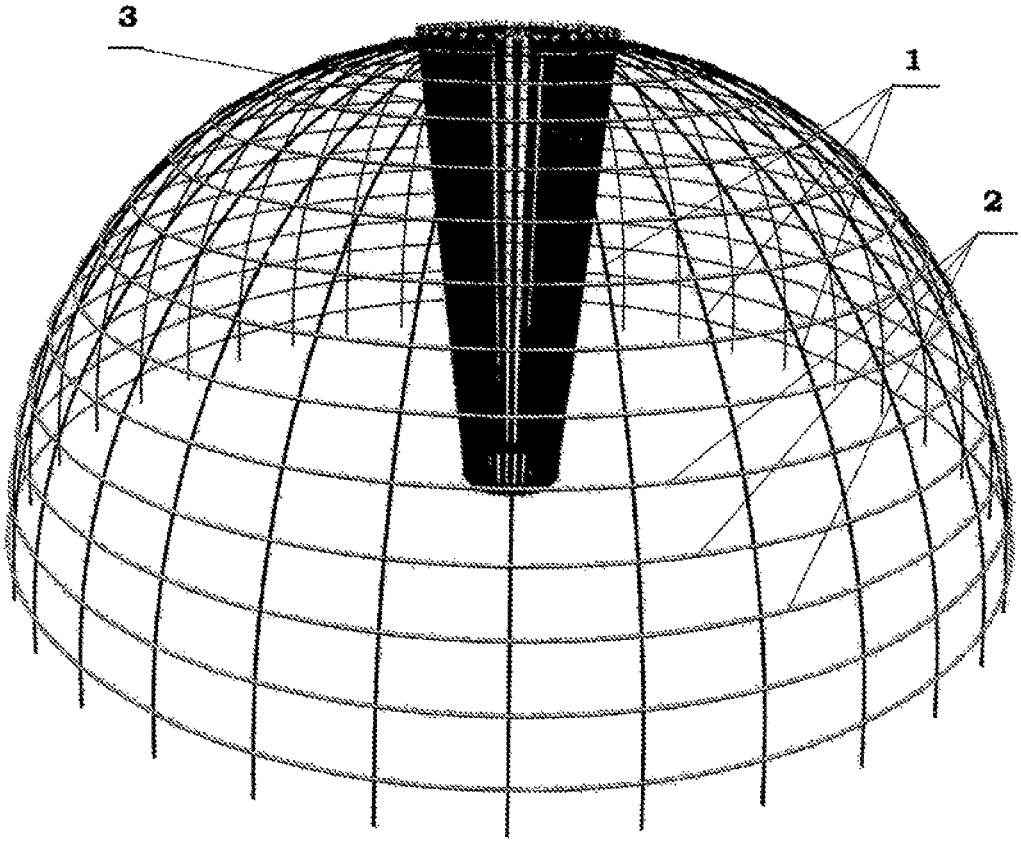
FIG. 1 is an axonometric view of a self-supporting three-dimensional prestressed structure shaped as a hemisphere.

An example of the construction of a self-supporting three-dimensional prestressed structure, is shown in FIG. 1. The example shows a self-supporting three-dimensional prestressed structure shaped as a hemisphere. The structure is constructed of vertical form-defining flexible rodlike members (1) stressed during the construction of the structure, as well as horizontally positioned flexible rodlike members (2) each forming a circular contour. The horizontal members which are also stressed are welded or rigidly joined by other means to the vertical form-defining rodlike members (1).

The horizontal circular contours are parallel to each other.

The device for construction of self-supporting three-dimensional prestressed structures is shown as (3) on FIG. 1.

Instead of horizontal circular members (2) the structure can be constructed completely or to some extent using a spiral member, also stressed during the construction of the structure that is rigidly affixed to the vertical form-defining flexible members (1).

Figure 2:
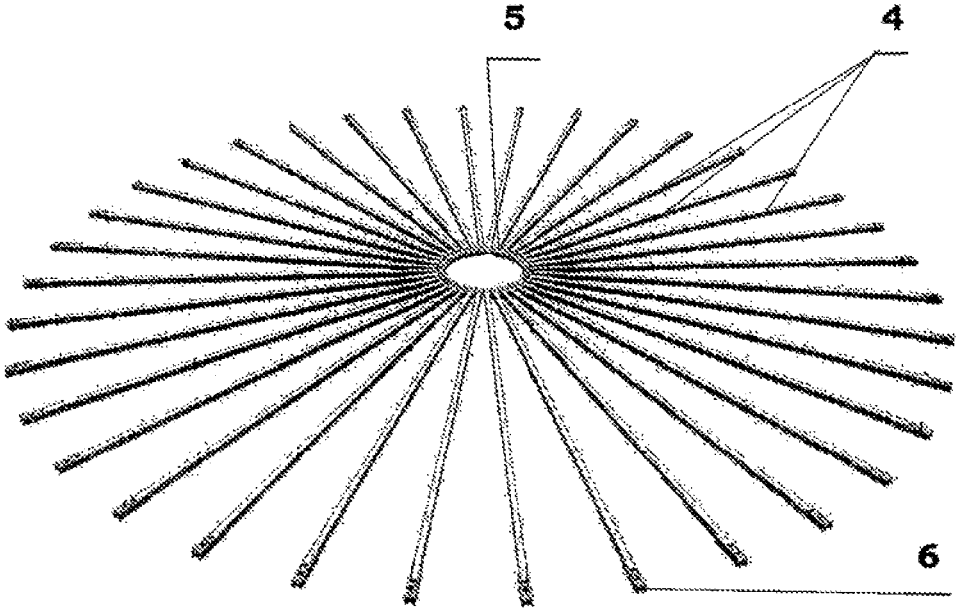
FIG. 2 shows a device for construction of self-supporting three-dimensional prestressed structures.
Figure 3:
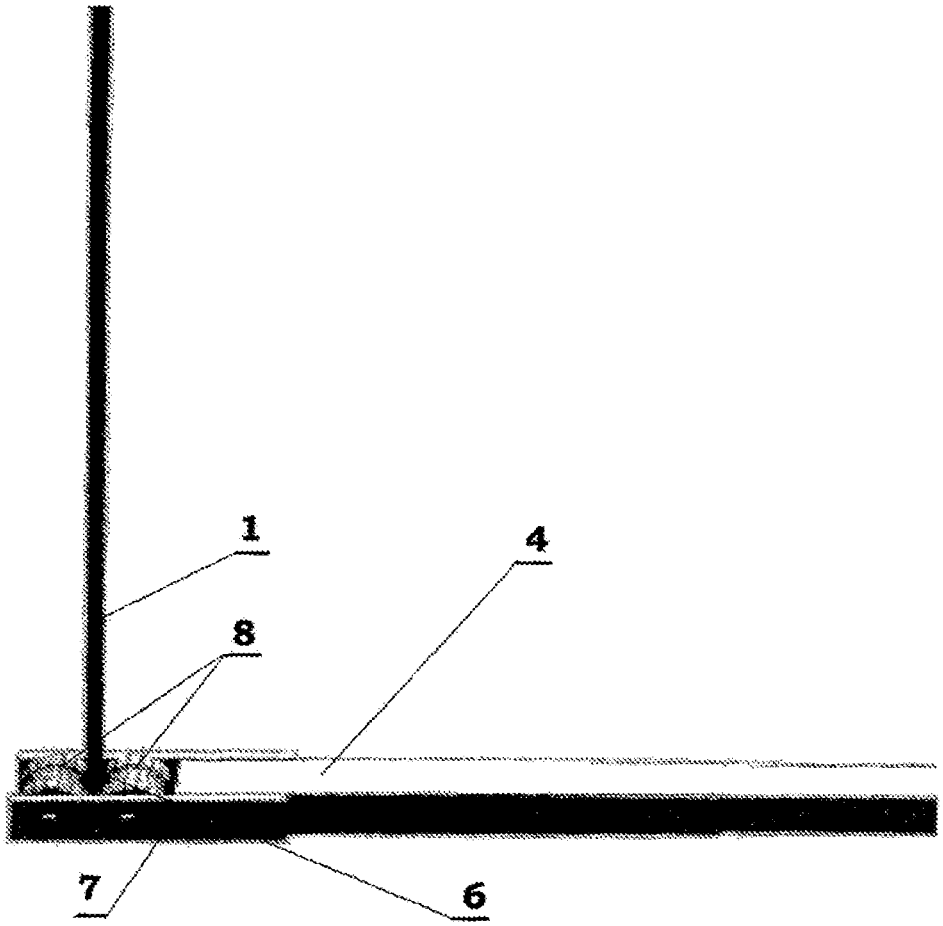
FIG. 3 is axonometric view of a guiding block fitting of the device for erecting the structure.

The device (3) for the construction of the self-supporting three-dimensional prestressed structure and the implementation or the method comprises a number of symmetrically and radially positioned telescopic arms (4) each hinged to a circle (5) positioned, at the center of the device FIG. 2. At the tip of each telescopic arm (4) there is a guide block fixing (6) FIG. 3. In this embodiment the guide block (6) comprises two parallel, plates or cheeks (7) fixed to the telescopic arm (4), whereas between said cheeks (7) are installed in sequence grooved rollers (8). The opening between the rollers (8) is at least equal to the cross-sectional diameter of the vertical rodlike member (1) to be held between them.

By varying the lengths of the telescopic arms (4) it is possible to configure three-dimensional prestressed structures with different shapes.

Figure 4:
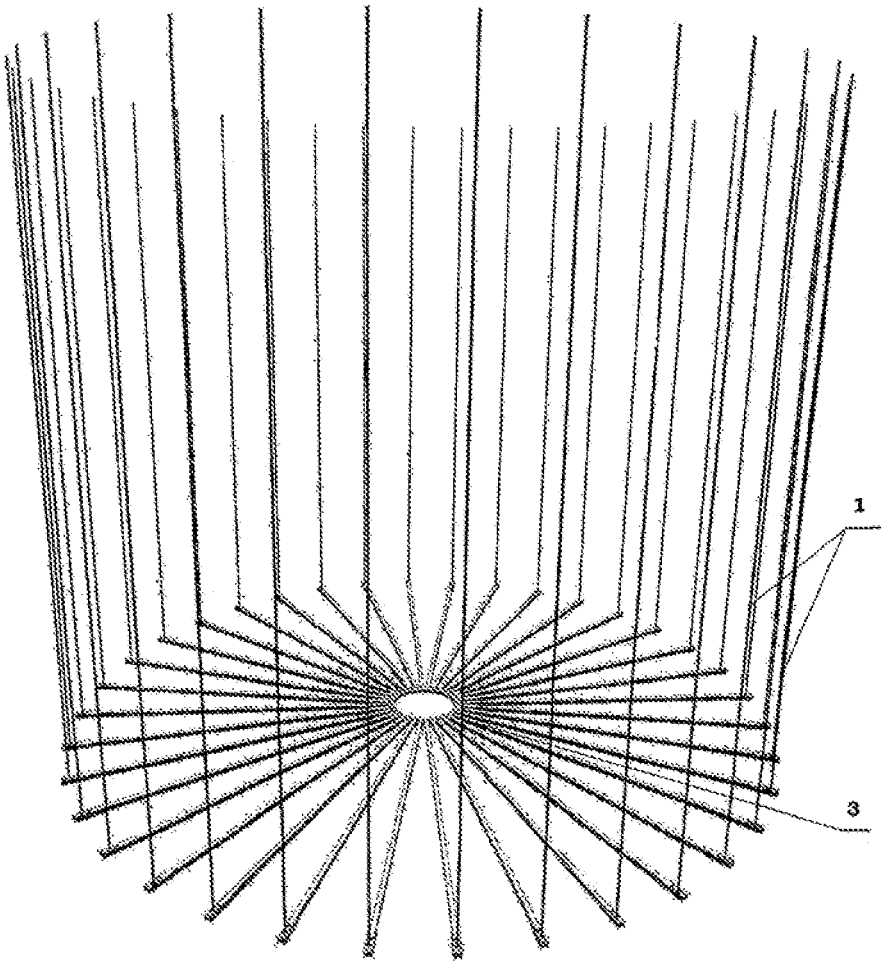
FIG. 4 shows the start of construction of a self-supporting three-dimensional prestressed structure.

The method for construction of self-supporting three-dimensional prestressed structures, which also explains the operating principle of the device, comprises the following operations in the sequence below:

1. A site and of a geometric center for the structure are selected. If the structure will be shaped as part of a sphere, such as a hemisphere (FIG. 4), the radius of the structure is also determined;

2. The site is leveled underneath the selected geometric center and a foundation is laid;

3. The material for the structure's framework is selected and prepared. Commonly used materials are flexible members (1), made for instance of wood, plastic or composite with rodlike or pipe profile;

4. The raster for the structure is determined, namely the number of the vertical and horizontal members for the intended structure with hemispherical (or more complex) shape. The thickness of the material and the raster are determined based on the intended purpose of the structure and the type of the material;

5. The device for construction of self-supporting three-dimensional prestressed structures (3) is then placed on the foundation and fixed to same;

The number of the telescopic arms (4) of the device corresponds to the number of the vertical rodlike members of the intended structure. When building a hemisphere, the length of the telescopic arms (4) is a constant number equal to the radius of the structure. When building more complex shapes, the length of each telescopic arm (4) can vary in each stage of the construction process, in order to achieve the intended complex three-dimensional shape.

6. The vertical rodlike members (1) are placed at regular intervals along the circumference of the intended structure, and then they are fed through the guiding blocks (6) of the telescopic arms (4). For better stability, the rodlike members (1) can be anchored into prepared sockets underneath the guiding blocks (6). The sockets can be prepared from sections of metal pipe with inside diameter greater than the diameter of the selected material that are driven into the foundation. If a concrete foundation is laid under the outside perimeter of the structure, the vertical flexible members can be affixed directly into the concrete.

Figure 5:
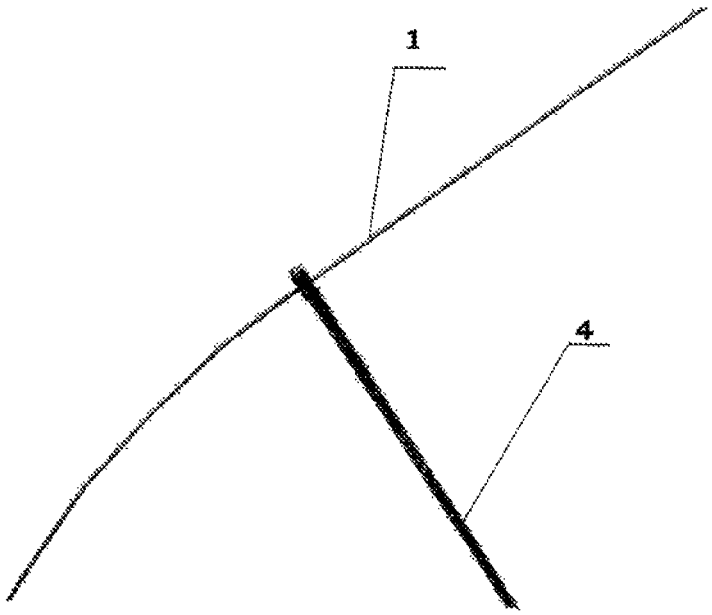
FIG. 5 shows a bent vertical rodlike member attached to a telescopic arm of the device.
Figure 6:
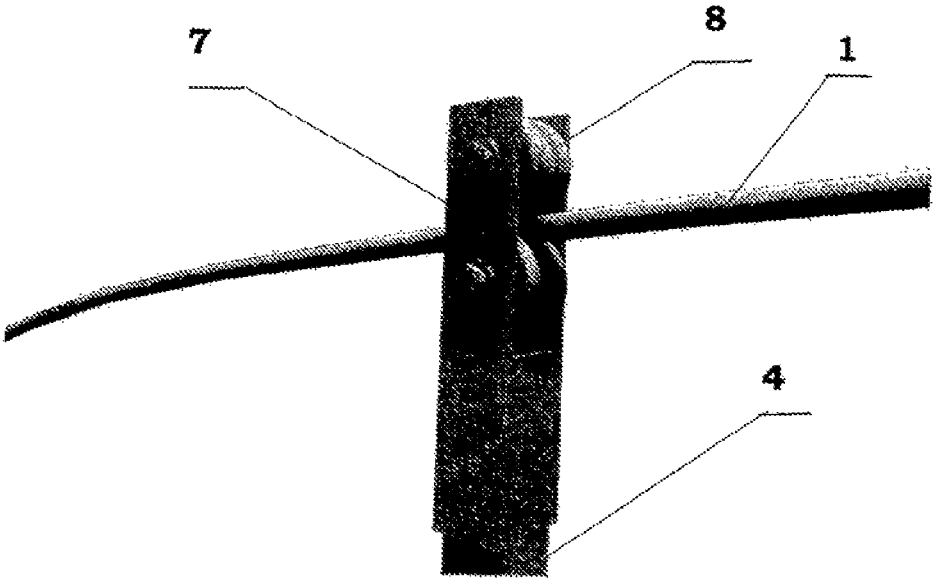
FIG. 6 shows a bent vertical rodlike member held in a guiding block fitting.

7. The next stage is the upward movement of the guiding blocks (6) of the telescopic arms (4) along the corresponding vertical rodlike members (1) FIGS. 5 and 6. The movement of each guiding block (6) along the corresponding flexible rodlike member (1) stresses it and forces is to form a circular arc.

The upward movement of all guiding blocks (6) along the vertical rodlike members (1) can be either sequential or simultaneous.

8. A horizontal circular member (2) is placed and affixed welded) around the bent vertical rodlike members (1).

Figure 7:
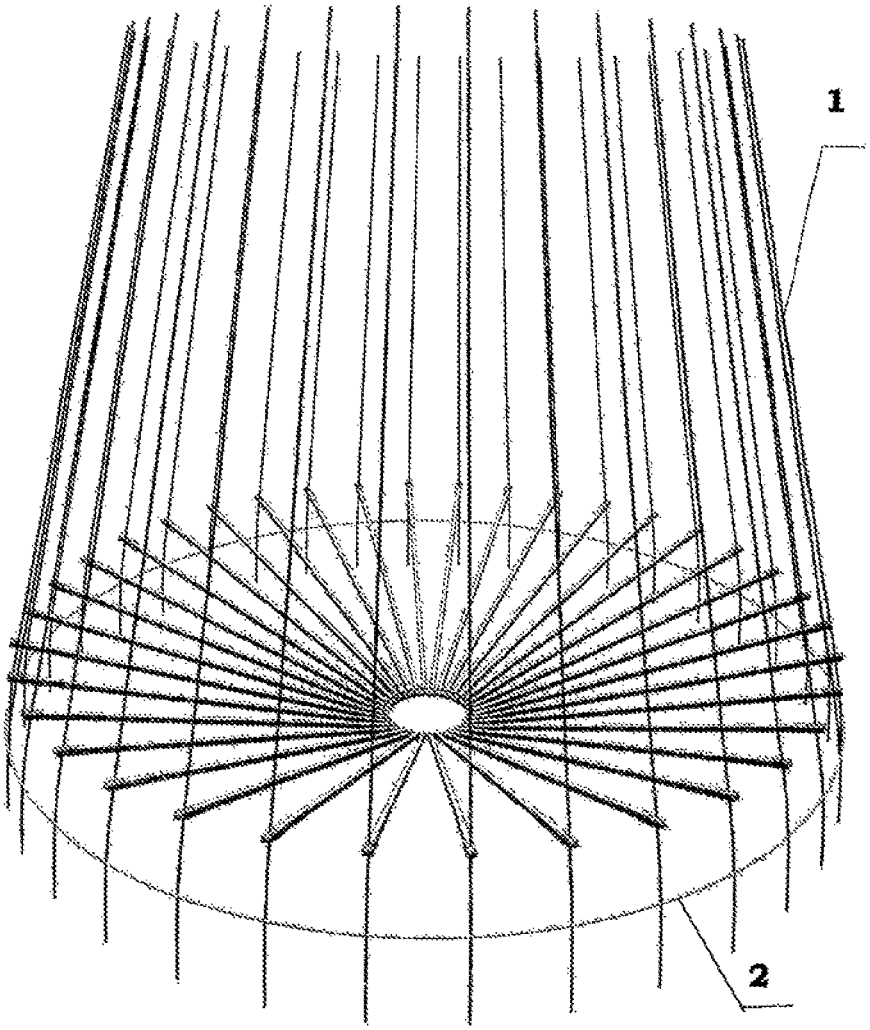
FIGS. 7 and 8 show consecutive stages of construction of a self-supporting three-dimensional prestressed structure.
Figure 8:
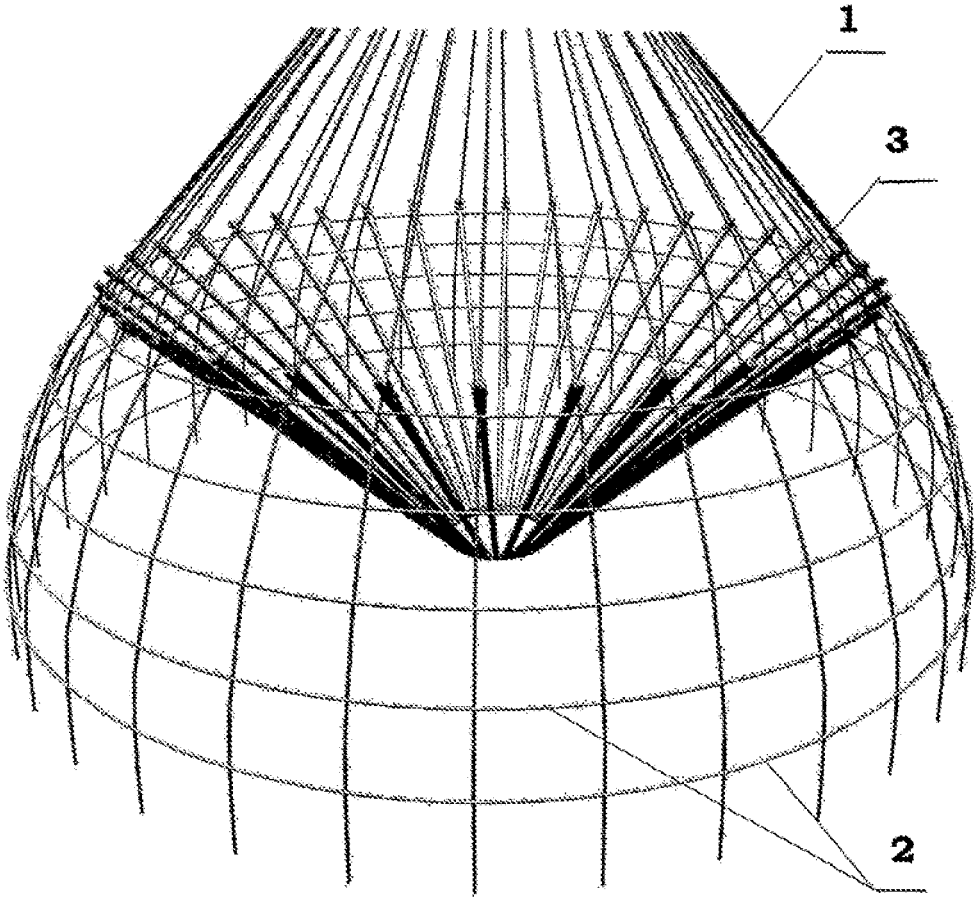

9. The upward movement of each telescopic arm (4) (at increments determined by the selected raster) is sequentially alternated with the attachment of a horizontal flexible rodlike member (2) (circular in the case of a hemisphere or with more complex closed-contour shape for a structure with a more complex shape)—FIGS. 7 and 8. The horizontal flexible rodlike members (2) are affixed rigidly to each vertical rodlike member (1) by means of a fitting or by welding. When each horizontal flexible rodlike member (2) is fully attached it fixes all vertical rodlike members (1) and equalizes their tension.

10. When the entire structure is complete the device (3) is in the configuration "all arms in a vertical bundle" FIG. 1. At this point the constructed three-dimensional structure is fully self-supported, and all forces/vectors acting on the structure are in equilibrium. At this stage the device (3) can be removed from the structure and be ready for reuse.

11. If the design requires the making of openings in the structure (doors, windows, etc.), the frames with the required dimensions and strength are made first, and then affixed at the required positions. The bordering sections of the structure are affixed/welded regularly to the frames, and only then the excess parts of the structure enclosed in the frames are cut away. Any cutting of unframed sections of the stressed structure would cause the abrupt release of the tension with catastrophic results.

Figure 9:
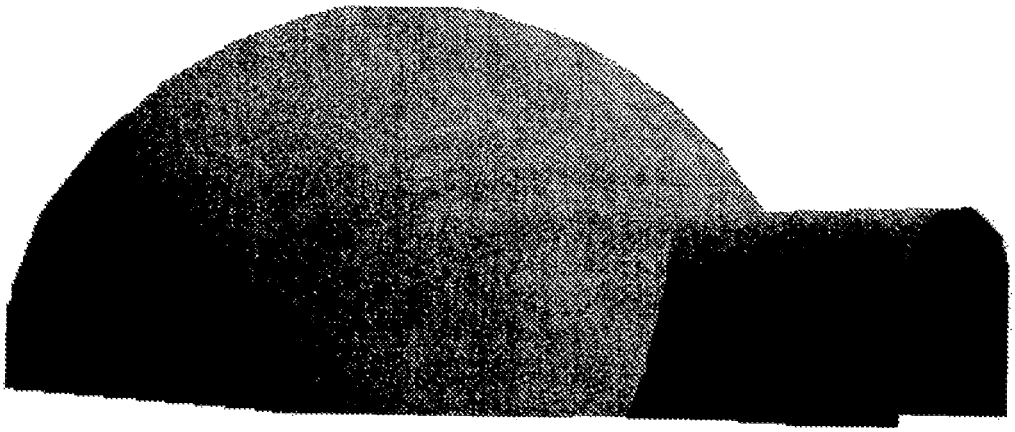
FIG. 9 shows a finished and covered self-supporting three-dimensional prestressed structure.

12 The complete structure can be covered in waterproofing or other material, or in concrete, and it can be used for civic and production halls, residential buildings, greenhouses, temples, swimming pools and other structures FIG. 9.

The invention claimed is:

1. A device for construction of self-supporting three-dimensional prestressed structure comprising a number of symmetrically and radially positioned telescopic arms (4) each hinged to a circle (5) positioned at the center of the device, wherein at the tip of each telescopic arm (4) a guide block holds a corresponding vertical member (1), wherein the telescopic arms remain hinged to the device at a base area of the structure, wherein the guide block comprises two parallel plates (7) fixed to the telescopic arms (4), and wherein between said plates (7) are installed in sequence grooved rollers (8), with an opening between two rollers (8) being at least equal to the cross-sectional diameter of the vertical member to be held between the two rollers.

2. A method for construction of self-supporting three-dimensional prestressed structures comprising:

selecting a geometric center for a structure;

positioning and affixing a central circle (5) of a device for construction of self-supporting three-dimensional prestressed structures at a geometric center of the structure;

configuring telescopic arms (4) of the device to conform to an intended size and shape of the structure;

inserting one end of a vertical member (1) through a guiding block (6) on a respective telescopic arm (4) and into a prepared socket in a foundation of the structure;

moving incrementally upward each telescopic arm (4) along its respective flexible vertical member (1), either in sequence or simultaneously, thus stressing the flexible vertical member (1);

following each incremental upward step of all telescopic arms (4), fixing an achieved elevation by attaching horizontal flexible members (2) around the flexible vertical members (1) to form a contour;

after the structure has been completed, removing the device (3), wherein the telescopic arms remain hinged to the device at a base area of the structure, making openings of shapes in the structure by making frames with required dimensions and shape, affixing the frames at required positions, affixing bordering sections of the structure to the frames, and cutting away excess parts of the structure enclosed in the frames, and sheathing the structure in reinforcing mesh and plastering over and finishing in building materials comprising at least one of cement, clay, and adhesive mix.

* * * * *